US010774469B2

(12) United States Patent
Costa

(10) Patent No.: US 10,774,469 B2
(45) Date of Patent: Sep. 15, 2020

(54) FID FOR ROPE SPLICING

(71) Applicant: Factor 55, LLC, Boise, ID (US)

(72) Inventor: Michael Douglas Costa, Boise, ID (US)

(73) Assignee: WARN INDUSTRIES, INC., Clackamas, OR (US)

( * ) Notice: Subject to any disclaimer, the term of this patent is extended or adjusted under 35 U.S.C. 154(b) by 282 days.

(21) Appl. No.: 15/792,720

(22) Filed: Oct. 24, 2017

(65) Prior Publication Data

US 2018/0119343 A1 May 3, 2018

Related U.S. Application Data

(60) Provisional application No. 62/414,447, filed on Oct. 28, 2016.

(51) Int. Cl.
*D07B 7/18* (2006.01)
*D07B 1/18* (2006.01)

(52) U.S. Cl.
CPC ..... *D07B 7/182* (2015.07); *D07B 1/185* (2013.01)

(58) Field of Classification Search
CPC ..... D07B 7/182; D04C 1/12
See application file for complete search history.

(56) References Cited

U.S. PATENT DOCUMENTS

| | | | | | |
|---|---|---|---|---|---|
| 1,534,926 | A * | 4/1925 | Doble | D07B 7/182 | 57/23 |
| 2,394,884 | A * | 2/1946 | Venancio | D07B 7/182 | 57/23 |
| 2,600,395 | A * | 6/1952 | Domoj | D07B 1/185 | 87/13 |
| 4,158,281 | A * | 6/1979 | Morang | D07B 7/182 | 57/23 |
| 5,699,657 | A * | 12/1997 | Paulson | B65H 69/06 | 28/142 |
| 2014/0260173 | A1* | 9/2014 | Stowe | B65H 69/06 | 57/23 |

* cited by examiner

*Primary Examiner* — Tajash D Patel
(74) *Attorney, Agent, or Firm* — K&L Gates LLP

(57) ABSTRACT

A fid is made of separate components that can be easily assembled and disassembled by the user. In this manner the fid components can be easily stored or transported and then assembled when needed to create a fid of sufficient length to splice a synthetic rope or other types of rope. The fid includes an elongate shaft or needle with a first that tapers to a point. The opposing end of the shaft may be machined to form a connection structure. A coupler may have an elongate form with two opposing ends along a center axis. One end of the coupler removable attaches to the needle at the connection structure. The second end of the coupler permanently attaches to a rope holder, which may take the form of a cylindrical, helically wound braid of thin wire cable forming a wire basket.

16 Claims, 8 Drawing Sheets

FID FOR ROPE SPLICING

CROSS-REFERENCE TO RELATED APPLICATION

This application claims benefit under 35 U.S.C. § 119 of the earlier filing date of U.S. Provisional Application No. 62/414,447 filed 28 Oct. 2016 entitled "Fid for rope splicing," which is hereby incorporated by reference in its entirety as if fully set forth herein.

TECHNICAL FIELD

The technology described herein relates to a fid for splicing rope and has particular application for splicing a thimble eye in high tensile strength ropes for towing, winching, and other high-tension applications.

BACKGROUND

A fid is a tool used to hold open knots and holes in canvas, and to separate the "lays" or strands of synthetic or natural rope for splicing. Many different designs for fids have been created throughout the centuries from sharpened bones or sticks to machined metal rods. In many modern configurations for rope splicing applications, fids are formed similar to knitting needles, with long, narrow, cylindrical shafts with a conically pointed tip end. One end of a rope is typically attached to an end of the fid opposite the pointed end. Most fids for synthetic rope splicing tend to be very long (e.g., up to 18 in. (45 cm) or longer) and have no structure for attaching an end of the rope to an end of the fid. Often the rope is merely taped to the end of the fid in order to attach the two together. This is not an elegant solution; it requires the availability of tape; and it often does not hold the rope sufficiently tight to resist the stress of the splicing activity. Other fid devices may define a threaded bore opposite the tip end into which the rope end may be twisted and held in place by the threading. This solution is also not desirable as the threads may also not provide an adequate retention force to hold the rope during splicing operations.

The information included in this Background section of the specification, including any references cited herein and any description or discussion thereof, is included for technical reference purposes only and is not to be regarded subject matter by which the scope of the invention as defined in the claims is to be bound.

SUMMARY

The technology disclosed herein relates to a fid that is made of separate components that can be easily assembled and disassembled by the user. In this manner the fid components can be easily stored or transported and then assembled when needed to create a fid of sufficient length to splice a synthetic rope or other types of rope. One component of the fid comprises an elongate shaft with a first that tapers to a point. The opposing end of the shaft may be machined to form a connection structure. In one embodiment, the connection structure may be a cylindrical end portion of the shaft. The end portion may be solid with threading as for a bolt formed in the outside surface thereof. Alternatively, the end portion may be hollow with threading on an interior cylindrical surface defining the hollow area.

An intermediate, interface component or coupler may have an elongate form with two opposing ends along a center axis. The coupler may have a first end that defines a cavity with threading on an interior cylindrical surface defining the cavity. Alternatively, the first end may be formed as a solid cylinder with threading as for a bolt formed in the outside surface thereof. The second end may also define a cavity for attaching the coupler to the third component of the fid that connects to an end of a length or rope.

The third component may take the form of a cylindrical, helically wound braid of thin wire cable or other similar flexible cable material forming a wire basket. A first end of the wire basket may be compressed and inserted into the cavity in the second end of the coupler and permanently affixed therein. In some embodiments second end of the coupler may be crimped to compress the sidewalls defining the cavity to crush against the first end of the wire braid and thereby retain the wire basket within the second end of the coupler. In other embodiments, the wire basket may be adhered within the cavity in the second end of the coupler or otherwise connected or retained therein.

The coupler with the attached wire basket may then be removably attached to the shaft by screwing the first end of the interface component onto (or within) the threaded end of the shaft to form the complete fid assembly.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

It is often desirable to splice lengths of rope together to make a longer length or rope or to splice a length of rope together with itself to form a structure for aid in connecting the rope to other devices or structures. For example, it may be desirable to form an eye in an end of a length of rope for easily connecting the rope to other devices, for example, a hook or a clevis, through which the rope may be easily attached to a load. Ropes with eyes so formed are often used in conjunction with a clevis, hook, caribiner, or other similar device for towing, winching, lifting, or lowering a load.

In recent years, high tensile strength, synthetic rope has been developed and used in towing and winching applications due to its lighter weight than steel cable and its higher strength under tension than steel cable of the same diameter. In fact, ropes woven of high-modulus polyethylene (HMPE) (e.g., Plasma, Spectra, Dyneema and Amsteel) are rated for many load applications including towing, winching, and mooring. Among other characteristics, HMPE rope has a high resistance to abrasion and ultraviolet degradation, low percentage of elongation, and it floats, which makes it favorable for marine applications. In addition, it is relatively easy to splice with a fid in accordance with the embodiments disclosed herein. In contrast, steel cables cannot generally be spliced and while loops or eyes can be formed, a ferrule must be crimped in place with a specialized crimping tool to hold two parallel wire cable sections together or a number of U-clamps may be bolted in place for the same purpose. In each case, the joint is rough and sharp and may not have achieve the same strength as a rope splice.

Figures 1, 2:
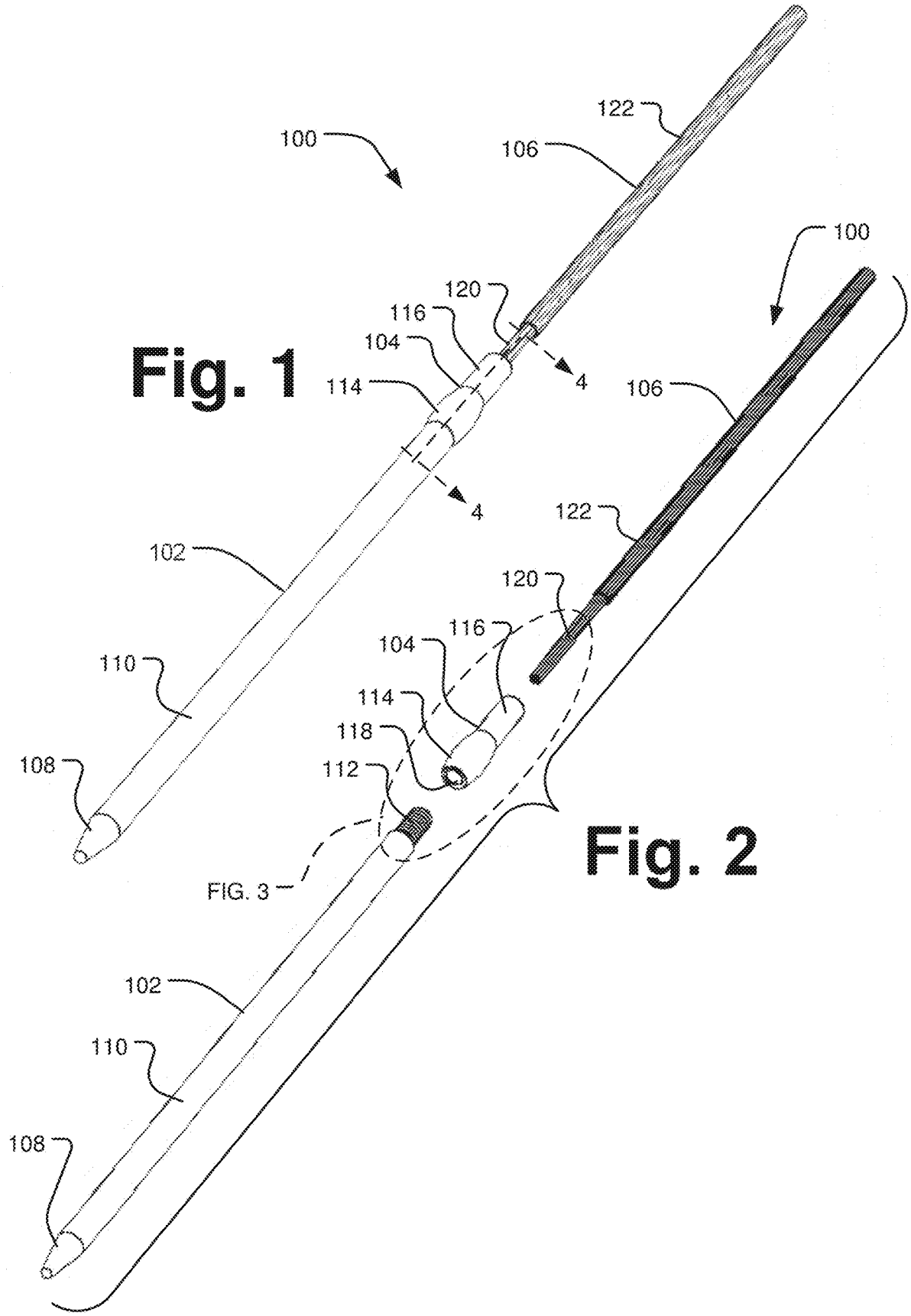
FIG. 1 is an isometric view of an assembled fid according to an exemplary implementation.
FIG. 2 is an isometric view of the fid of FIG. 1 disassembled in three components.

An exemplary implementation of a fid 100 constituted of separate components that can be easily assembled and disassembled by the user is shown in FIG. 1. In this configuration the fid 100 can be easily stored or transported and then assembled when needed to create a fid 100 of sufficient length to splice a synthetic rope or other types of rope. As detailed in the exploded view of FIG. 2, the fid 100 may be composed of three primary parts, a needle 102, a coupler 104, and a rope holder 106. The needle 102 may be formed as an elongate, cylindrical shaft 110 with a conically-shaped tip 108 at a first end of the shaft 110. In other embodiments, the cross section of the shaft 110 could take other forms than circular, for example, triangular, square, hexagonal, octagonal, elliptical, or other forms. The needle 102 may be made of steel, aluminum, or other metal or, in some embodiments, a high-strength plastic. A threaded connector 112 may be formed on a second end of the needle shaft 110 opposite the needle tip 108. The threaded connector 112 may be formed on an outer surface of the cylindrical needle shaft 110 as shown. The outer diameter of the threads of the threaded connector 112 may be slightly less than a diameter of the needle shaft 110. In alternate embodiments the threaded connector may be formed in a bore in the second end of the needle shaft with threading provided on an inside surface of a cylindrical wall refining the bore.

Figure 3:
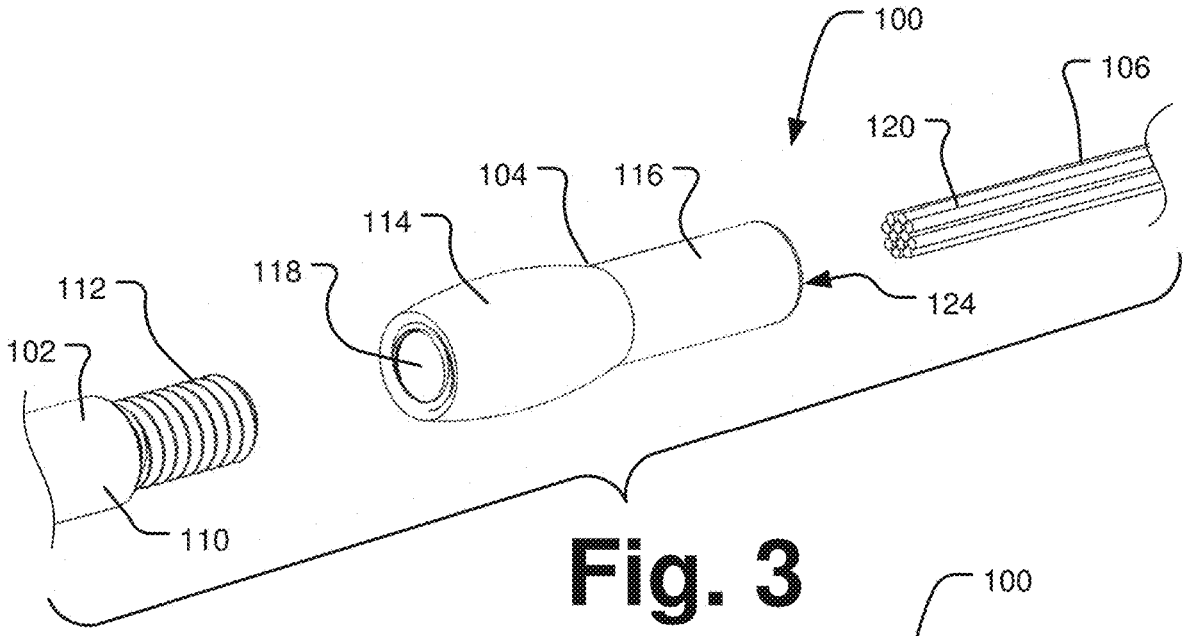
FIG. 3 is an enlarged, isometric view of a portion of the disassembled fid components as indicated in FIG. 2.
Figure 4:
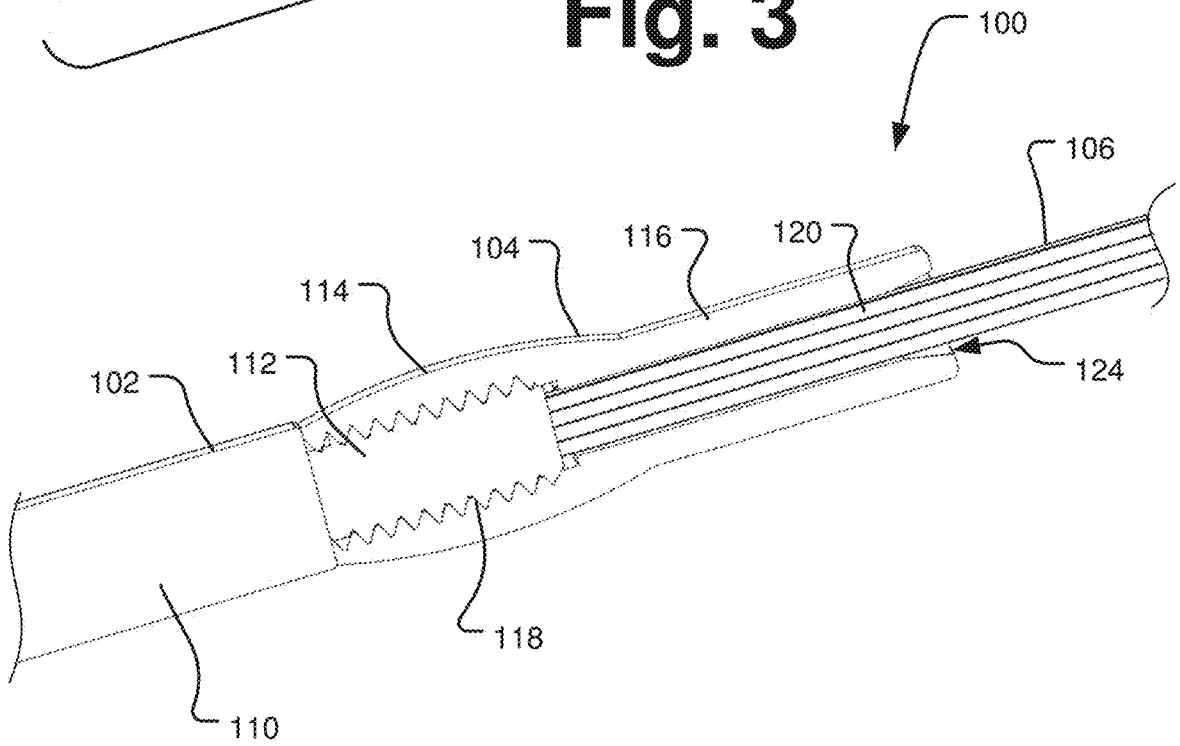
FIG. 4 is a cross-section view of a portion of the assembled fid as indicated in FIG. 1.

As depicted in greater detail in FIGS. 3 and 4, the coupler 104 provides an interface between the needle 103 and the rope holder 106. The coupler 104 may be formed as a molded or machined metal or plastic tube composed of two sections. A needle receiver 114 forms a first section of the coupler 104 and is configured to mate and removably connect with the threaded connector 112 on the needle shaft 110. The needle receiver 114 may define a threaded cylindrical sleeve 118 for mating with the threaded connector 112 of the needle 102, i.e., the threaded connector 112 may be screwed into the threaded sleeve 118 to connect the needle 102 to the coupler 104. As the diameter of the threaded connector 112 may be slightly less than a diameter of the needle shaft 110, the outer surface of the needle shaft 110 may seamlessly abut the outer surface of the coupler 104. Alternatively, in another embodiment, the threaded connector of the needle could be a female threaded socket and the coupler could instead define a shaft with threading on an outer surface thereof for mating with the threaded connector on the needle. In an exemplary embodiment, the second section of the coupler 104, referred to herein as ferrule portion 116, may be a formed as hollow shaft extending from the needle receiver 114 that defines a ferrule cavity 124 therein.

In the exemplary implementations disclosed herein, the rope holder 106 may take the form of a cylindrical, helically-wound, wire basket 122. The due to the nature of the weave, the wire basket 122 may be compressed or elongated along the center longitudinal axis of the cylindrical form. As the wire basket 122 is elongated, e.g., by pulling on the longitudinal ends, the diameter of the wire basket 122 decreases. As the wire basket 102 longitudinally shortens, e.g., by pushing each longitudinal end toward the other, the diameter of the wire basket 122 increases. In an elongated state creating a narrow diameter, one end of the wire basket 122, referred to herein as the crimped portion 120, may be inserted within the ferrule cavity 124 of the ferrule portion 116 of the coupler 104. The ferrule portion 116 may then be crimped about the crimped portion 120 of the wire basket 122 to permanently retain the crimped portion 120 within the ferrule portion 116 and thus connect the rope holder 106 to the coupler 104. In other embodiments, the crimped portion 120 may be retained within the ferrule portion 116 by other methods or structures, for example, by adhesive, welding, or a mechanical fastener.

Figure 5:
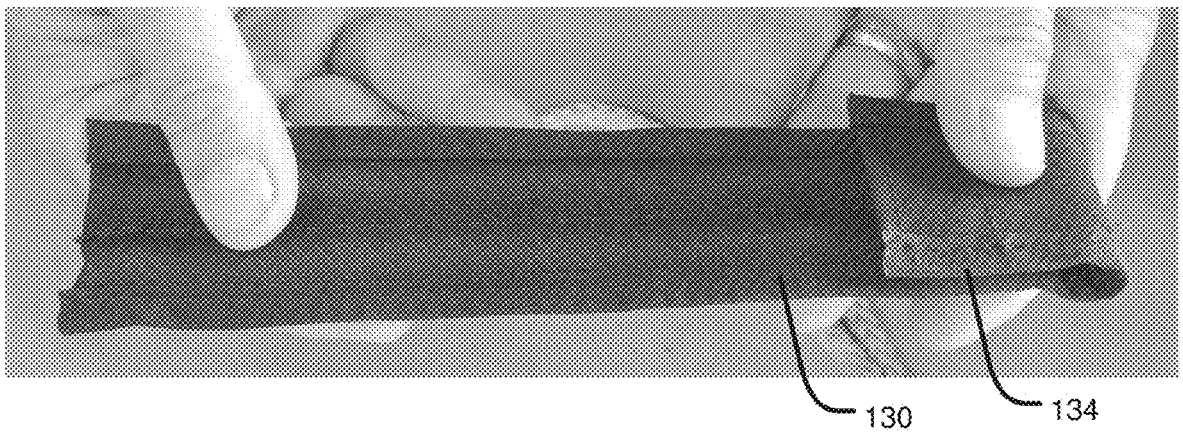
FIG. 5 is an image of a storage pouch for the components of a disassembled fid.
Figure 6:
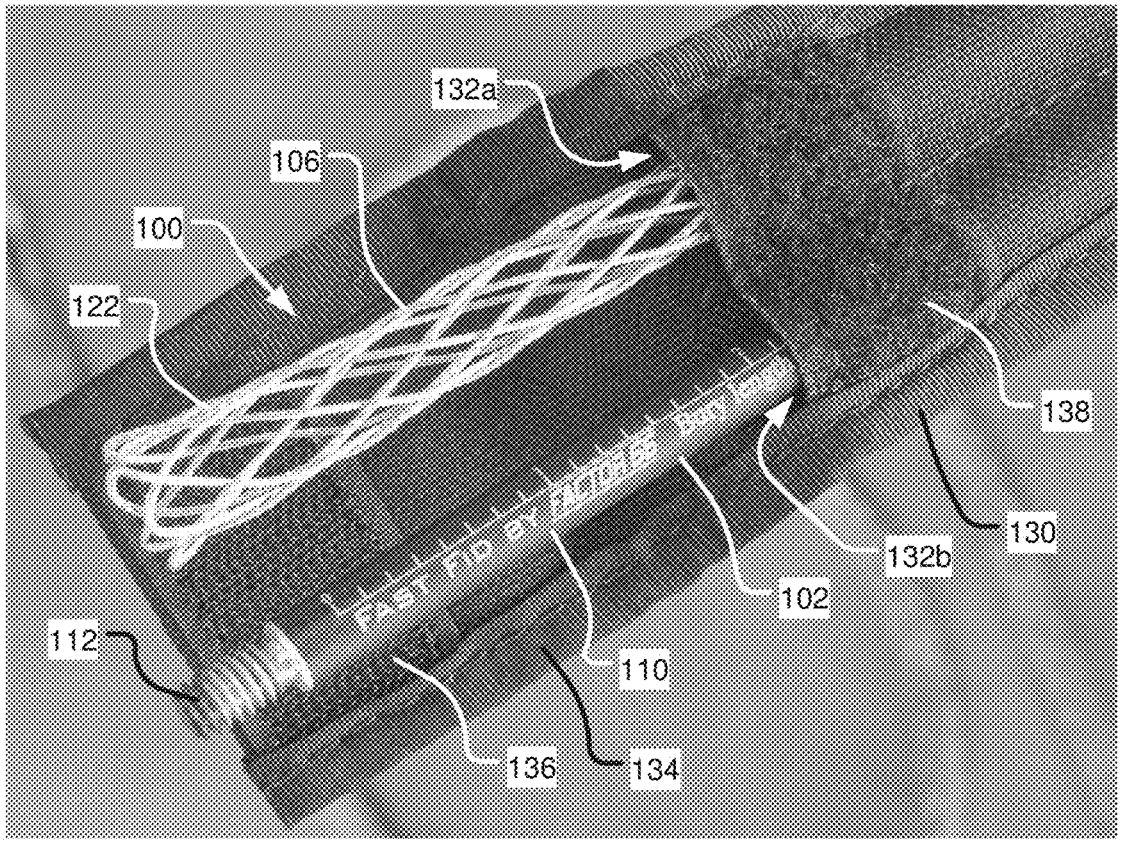
FIG. 6 is an image of the fid components partially inserted into the pouch of FIG. 5.

Exemplary methods for storage, assembly, and use of the fid 100 depicted in and described with respect to FIGS. 1-4, are presented in conjunction with FIGS. 5-17. FIGS. 5 and 6 depict an exemplary storage pouch for holding the components of the disassembled fid 100. The pouch 130 may be formed with two pockets 132*a/b* in which the needle 102 and the combined coupler 104 and rope holder 106 may be inserted and stored. A flap 134 with a closure structure 136 (e.g., half of a hook and loop fastener material) may be provided to retain the components of the fid 100 within the pouch 130 by covering the open ends of the pockets and fastening to a closure structure 138 on an outer surface of the pouch 130 (e.g., and opposing half of a hook and loop fastener material). Other closure structures may include buttons, snaps, ties, etc.

Figure 7:
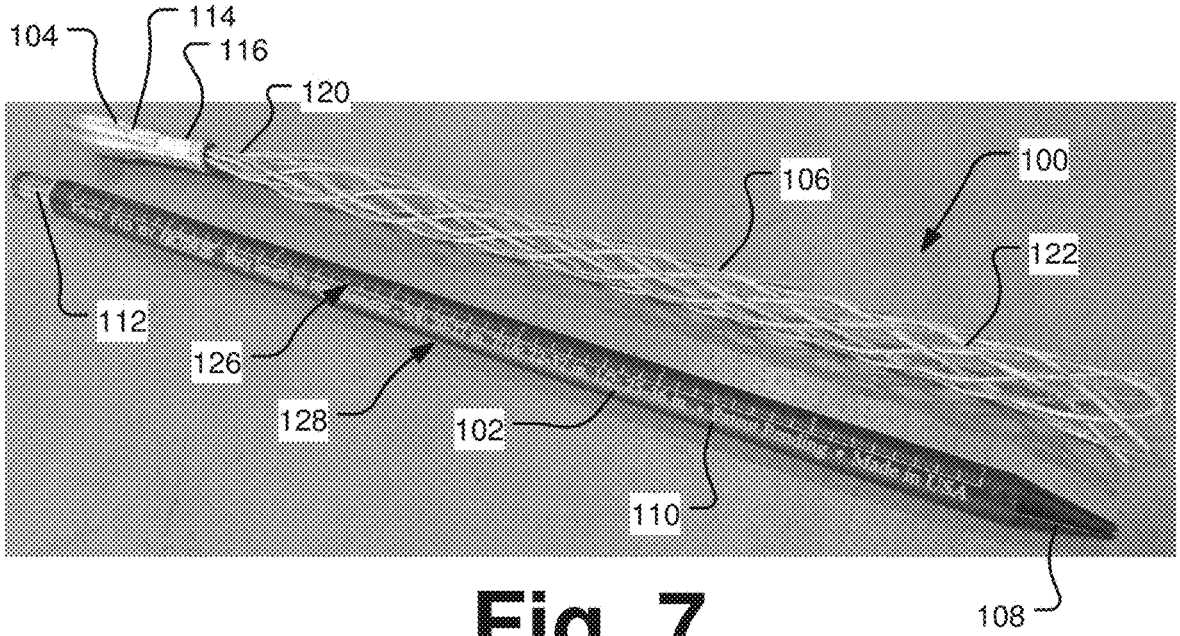
FIG. 7 is an image of the separate fid components.
Figure 8:
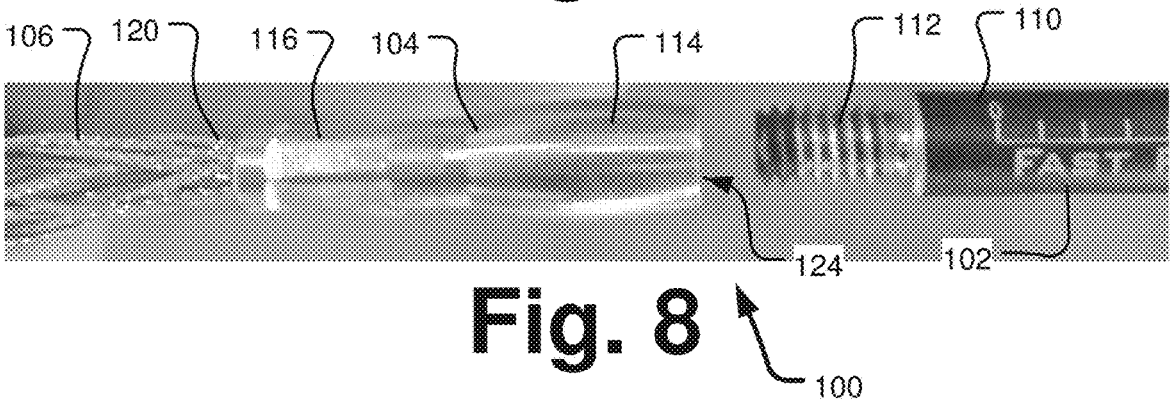
FIG. 8 is an image of a portion of the fid components readied for assembly by screwing the interface component and the shaft together.

The needle 102 and the combined coupler 104 and rope holder 106 may be removed from the pouch 130 and assembled by screwing the coupler 104 onto the threaded connector 112 on the end of the needle shaft 110 as shown in FIGS. 7 and 8. The needle shaft 110 may also be provided with additional features to aid in the splicing process. As shown in FIG. 7, the needle shaft 110 may have a number of markings printed thereon. One set of markings may be bury length markings 126 provided to aid the user in measuring the length of the splice to be made in the rope or the size of opening for an eye to be spliced. The bury length markings 126 may be in the form of a common measurement scale, for example, inches or centimeters. In the example of FIG. 7, the bury length markings 126 are shown in inches and 7 inches are marked on the needle shaft 110. The entire length of the needle 102 from the tip 108 to the end of the threaded connector 112 may be 8.25 inches as in the exemplary embodiment shown or it may be any other shorter or longer length as desired. The needle shaft 110 may further be provided with bury depth guide markings 128, which indicate to the user the recommended bury depth of the end of the rope within the splice in order to ensure that the splice will hold under tension. For example, with respect to typical HMPE rope, a bury length of 20-27 inches may be recommended to form a structurally sound splice in ⅜ in. diameter rope. Similarly, a bury length of 22-32 in. may be recommended to form a structurally sound splice in 7/16 in. diameter rope and a bury length of 25-36 in. may be recommended to form a structurally sound splice in ½ in. diameter rope.

Figure 9:
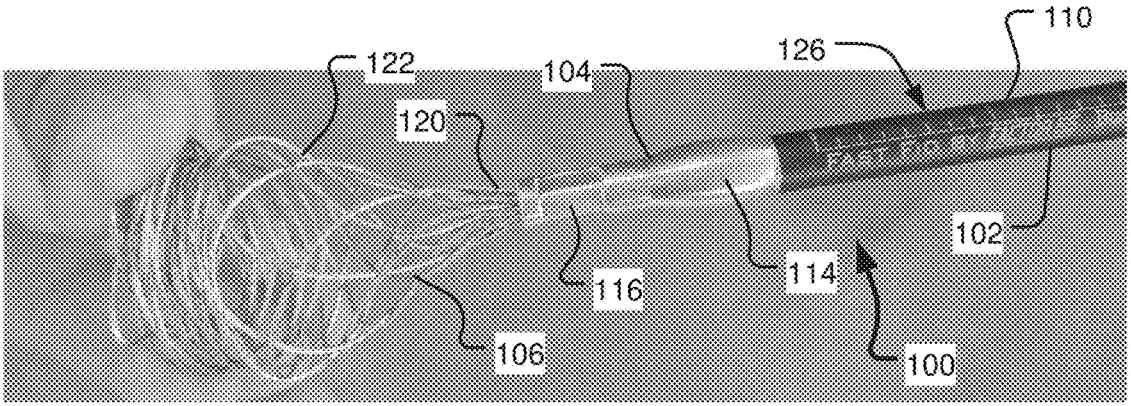
FIG. 9 is an image of the helically braided cable of the fid compressed longitudinally to create a larger diameter for receipt of an end of rope.
Figure 10:
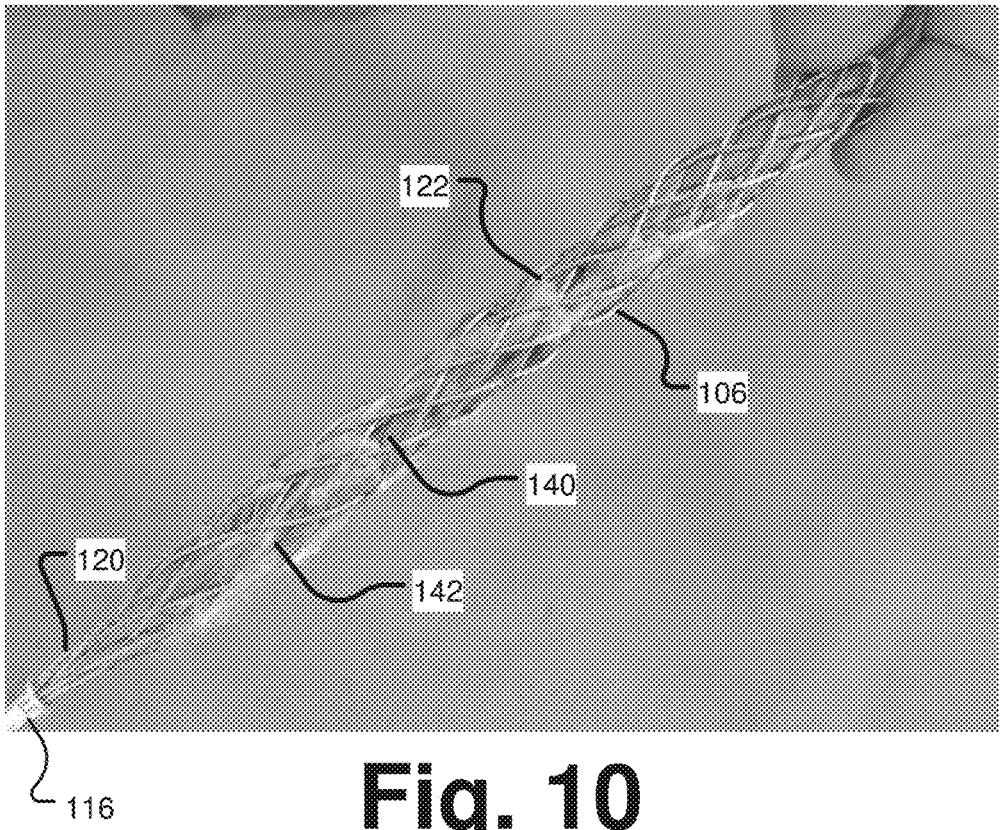
FIG. 10 is an image of an end of a length of rope trapped within the helically braided cable.

In order to attach an end of a rope to the fid 100, the wire basket 122 needs to be prepared to receive it. As shown in FIG. 9, the open end of the wire basket 122 may be pushed toward the coupler 104 in order to increase the diameter of the wire basket 122. A free end of a length of rope 140, referred to herein as a bury end 142 of the rope 140, may be inserted into the wire basket 122 and then the wire basket 122 may be elongated by pulling on the open end of the wire basket 122 along the bury end 142 of the rope 140 until the wire basket 122 tightly grips the bury end 142 as shown in FIG. 10. The tightening is simply a normal behavior of a cylindrical, helically wound braid, usually the common biaxial braid. Pulling the entire braid of the wire basket 122 lengthens and narrows it. The length is gained by reducing the angle between the warp and weft threads of the biaxial braid at their crossing points, which reduces the radial distance between opposing sides and hence the overall circumference. The more one pulls, the more the circumference shrinks and the braid tightens. Thus, the wire basket 122 functions to retain the bury end 142 when in longitudinal tension with respect to each other like a "Chinese finger trap" toy.

Figure 11:
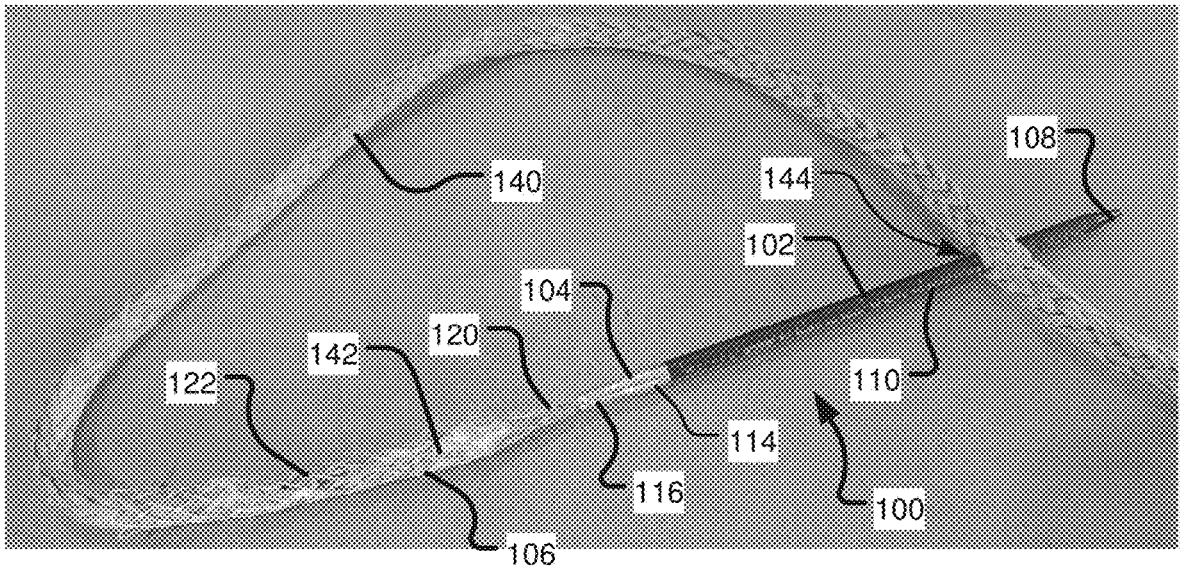
FIG. 11 is an image of a needle tip of the fid inserted within a length of the rope at a first strand pass-through location.
Figure 12:
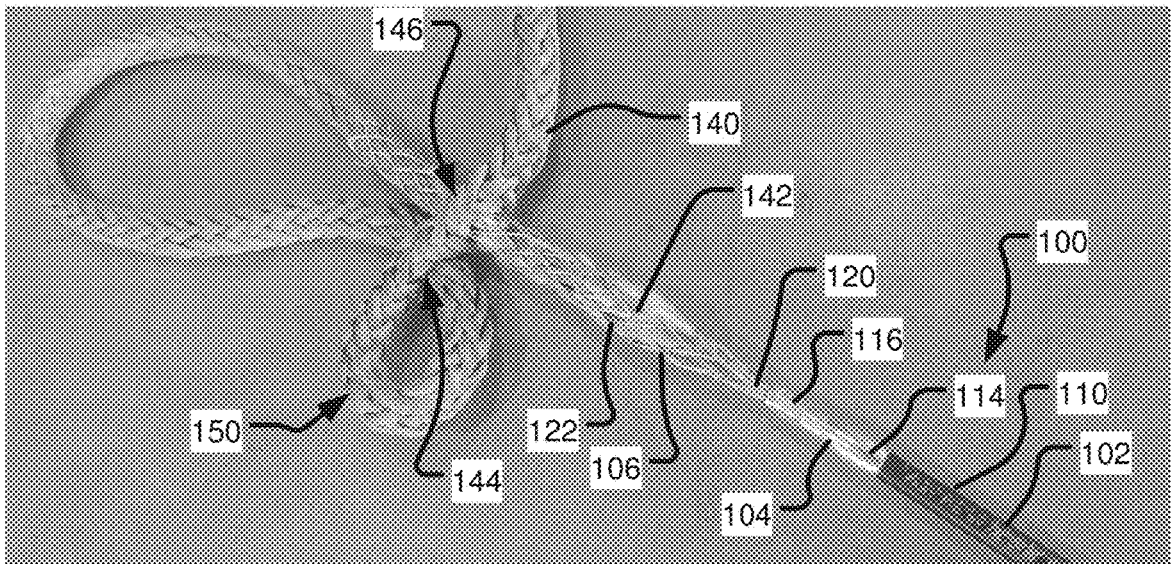
FIG. 12 is an image of a wire basket of the fid interlaced within a length of the rope at a second strand pass-through location.
Figure 13:
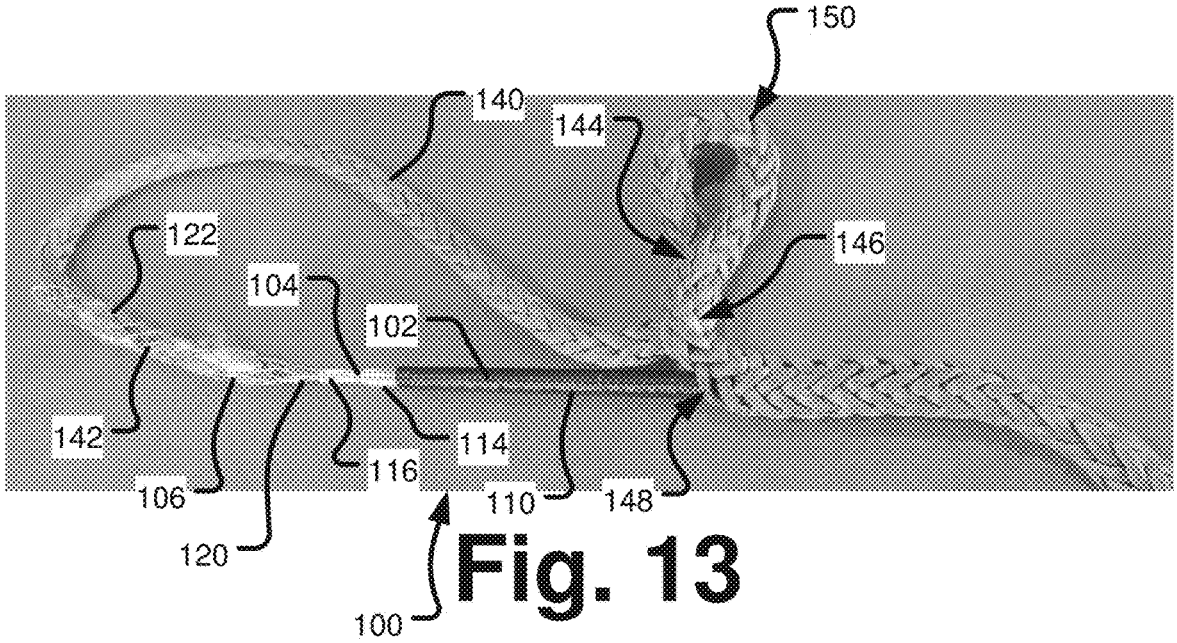
FIG. 13 is an image of a needle tip of the fid inserted within a length of the rope at a bury opening position.

A splice within the rope 140 to form an eye may be initiated as shown in FIG. 11. The tip 108 of the needle 102 may be passed between the braids of the rope 140 at a first strand pass-through location 144 at a distance along the length of the rope 140 away from the bury end 142 to form a loop for a rope eye 150. This distance for the first strand pass-through location 144 from the free end of the bury end 142 of the rope 140 may be calculated to be the combination of the desired bury length to form a strong splice and the desired circumference of the rope eye 150. The entire fid 100 may be pulled through the rope 140 at the first strand pass-through location 144 until a desired size of a rope eye 150 is created. The tip 108 of the needle 102 may then be passed between the braids of the rope 140 at a second strand pass-through location 146 closely adjacent to the first strand pass-through location 144 opposite the rope eye 150 and in an opposite lateral direction from the direction the bury end 142 passed through the rope 140 at the first strand pass-through location 144. The bury end 142 may be pulled fully through the second strand pass-through location 146 as shown in FIGS. 12 and 13.

Figure 14:
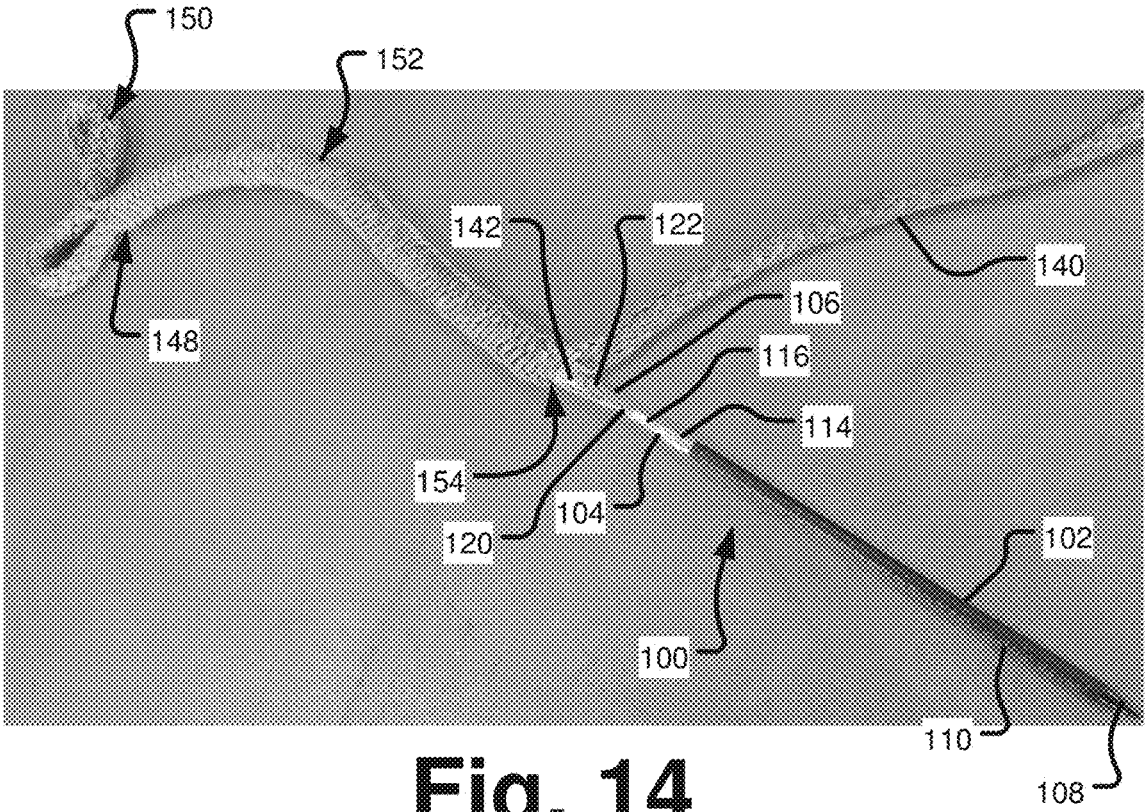
FIG. 14 is an image of the fid exiting the length of rope at a bury exit location.
Figure 15:
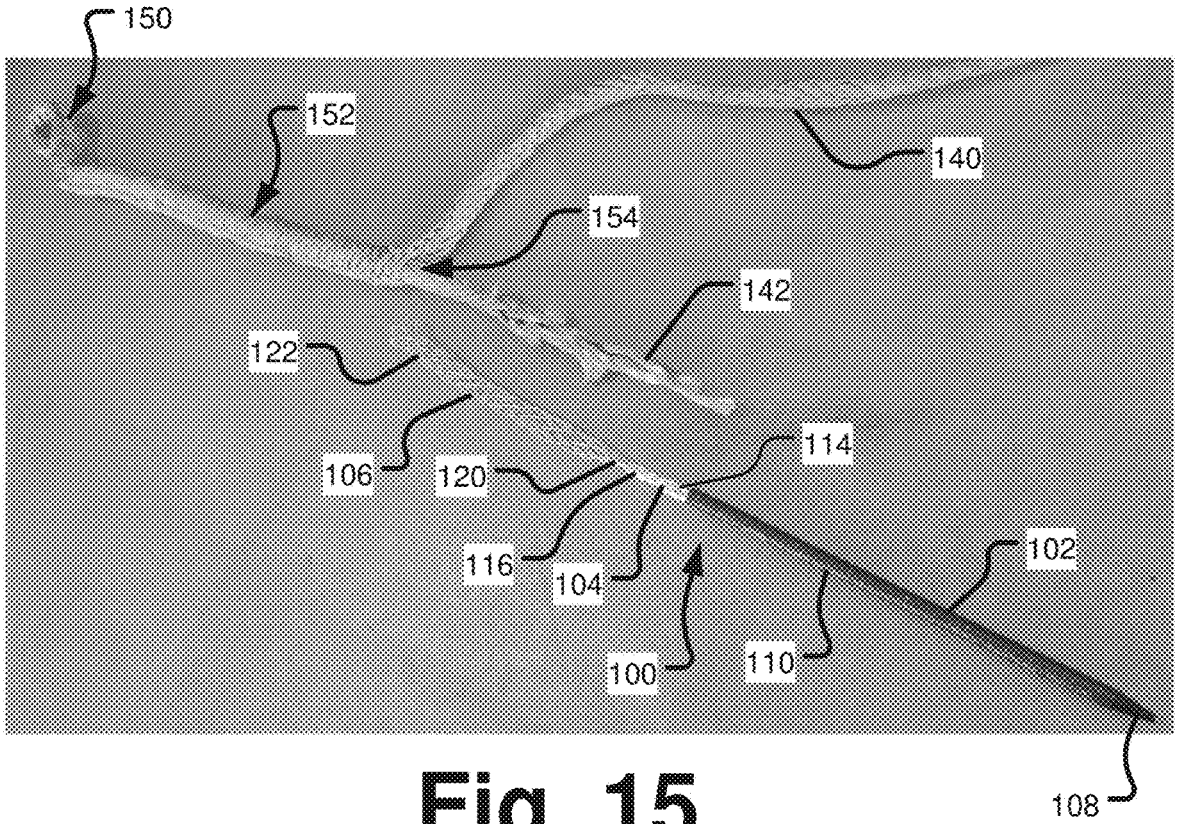
FIG. 15 is an image of the fid separated from the rope end and the rope end extending from the bury exit location after being laced through a section of the rope in a bury sleeve.
Figure 16:
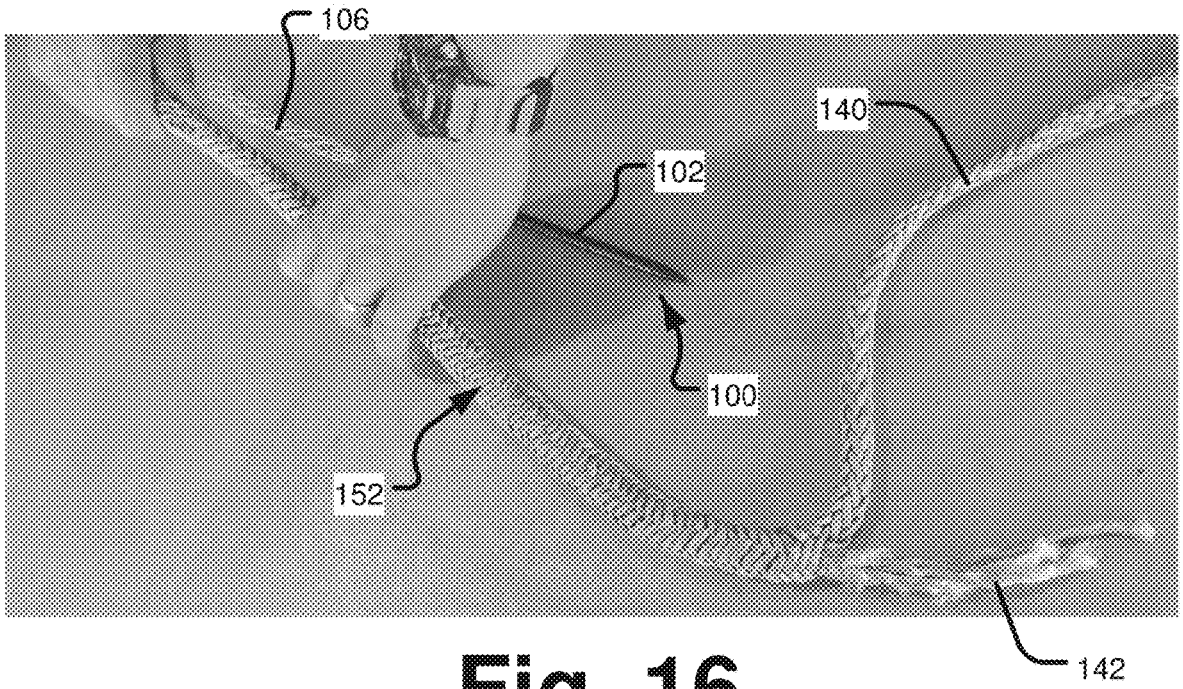
FIG. 16 is an image of a fabricator smoothing an elongating the bury sleeve section of the rope to fully encapsulate the rope end therein.

The needle tip 108 may then be inserted in to the rope 140 at a bury opening location 146 closely adjacent to the second strand pass-through location 146 further away from the rope eye 150. The needle 102 may be directed down the longitudinal core of the rope 104 within a core channel surrounded by the braided strands forming the rope 140. The entire fid 100 is advanced within and along the length of the rope 140 for the entire length of the bury end of the rope 140 within a bury sleeve portion 152. The needle tip 108 may be pushed out of the core of the rope 140 at a bury exit location 154. The needle 102, the core 104, and the rope holder 106 may all be expressed through the bury exit location 154 by bunching the rope 140 in the bury sleeve portion 152 toward the eye 150 to shorten the length and increase the diameter as shown in FIG. 14. The bury end 142 of the rope 140 may then be removed from the rope holder 106 by bunching the braid of the wire basket 122 longitudinally to increase the diameter and release the bury end 142 as shown in FIG. 15. The user may then sleeve the bunched bury sleeve portion 152 of the rope 140 beneath the rope eye 150 toward the bury exit location 154 to pull it over and re-encapsulate the bury end 142 within the bury sleeve portion 152 of the rope 104 extending from the rope eye 150. Any excess length of the bury end 142 extending beyond the bury exit location 154 may be trimmed with a cutting tool.

Figure 17:
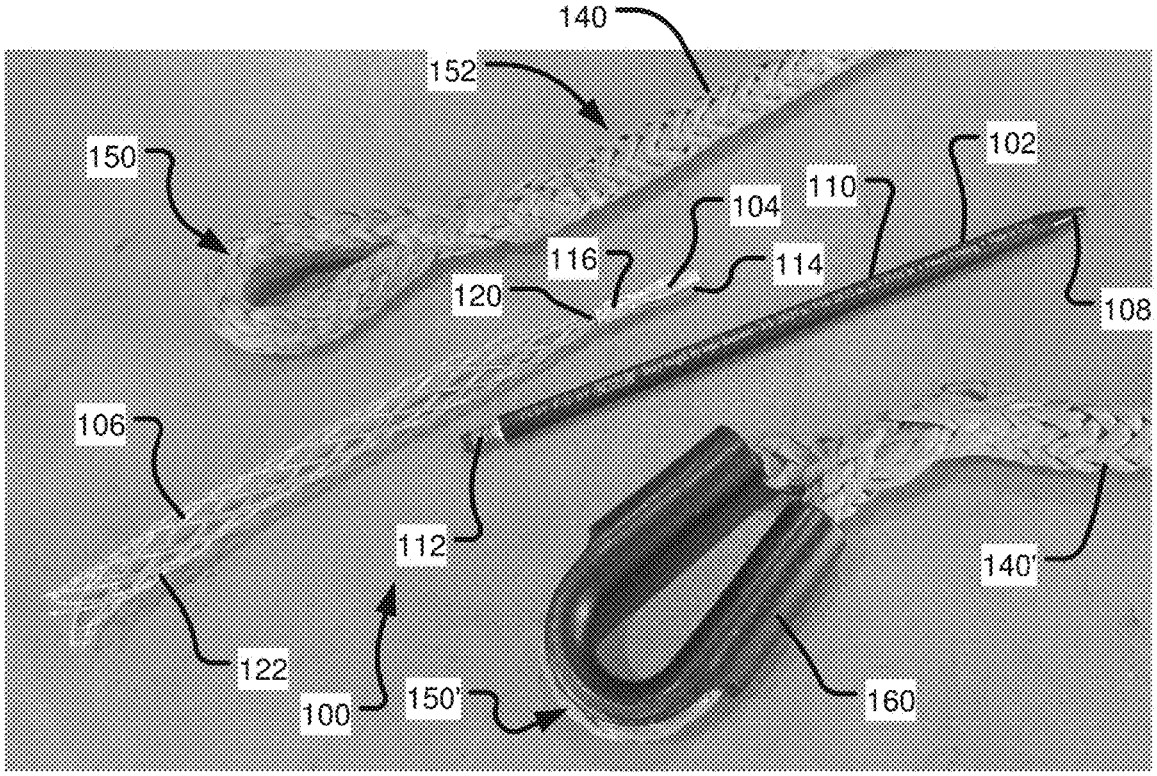
FIG. 17 is an image of a first rope eye formed using the fid via the steps of FIGS. 9-16, an image of the fid in a disassembled state, and an image of a second rope eye formed as above and also around an through a metal thimble.

A completed form of a spliced rope 140 forming a rope eye 150 at a terminal end of the rope 140 is shown in FIG. 17. The splice 156 thereby formed within the rope 140 results in a smooth surface of the rope 140 through the bury sleeve portion 152 and around the rope eye 150 at the terminal end of the rope 140. When under tension, the rope 140 elongates and the circumference of the rope wave reduces to compress the bury end 142 within the bury sleeve 152. This radially inward compression force holds the bury end 142 within the bury sleeve 152 to maintain the strength of the splice 156. The weaving of the bury end 152 of the rope 140 through the first and second strand pass-through locations 144, 146 also helps prevent the splice 156 from failing when the rope 140 is placed under tension. Additionally, stitching with a strong, small-diameter cord through the splice 156 may be used to prevent slippage of the bury end 142 within the bury sleeve 152 and thereby maintain the integrity of the splice. Once the splice 156 is complete, the fid 100 may be disassembled and stored in the pouch 130.

An alternate implementation of a rope eye 150' is also presented in FIG. 17. In this embodiment, the rope 140' is threaded through and around a steel thimble 160, which provides form and reinforcement to the rope eye 150', particularly against crushing and friction forces that could damage the rope 140 when the rope eye 150' is under tension. The rope 140' may first be fed through the thimble 160 before attachment of the fid 100 to the bury end of the rope 140' to begin the splicing operation and a first strand pass-through location immediately adjacent a point at which the bury end of the rope 140 exits a channel of the thimble 160.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto may vary.

The above specification, examples, and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A fid comprising an elongate needle having a tip at a first end and a connection structure at an opposing second end;

a coupler having an opposing connection structure at a first longitudinal end configured to releasably and removably couple with the connection structure of the elongate needle and further having a connector comprising a ferrule in the form of a sleeve at a second longitudinal end; and a rope holder configured to retain an end of a rope within a first end thereof and a having a second end configured for coupling with the connector of the coupler, wherein the second end of the rope holder resides within the sleeve and is permanently affixed to the coupler through the connector, and the sleeve is in a crimped configuration, compressing radially inward against the second end of the rope holder to permanently retain the second end of the rope holder within the ferrule.

2. The fid of claim 1, wherein the connection structure on the elongate needle comprises a threaded shaft; and the opposing connection structure on the coupler comprises a threaded surface on an interior wall of a bore defined within the coupler.

3. The fid of claim 1, wherein the connection structure on the elongate needle comprises a threaded surface on an interior wall of a bore defined within the second end of the elongate needle; and the opposing connection structure on the coupler comprises a threaded shaft.

4. The fid of claim 1, wherein the elongate needle comprises a shaft and a measuring tool in the form of bury length markings is provided along a length of the shaft.

5. The fid of claim 1, wherein the elongate needle comprises a shaft and an informational tool in the form of bury depth markings is provided along a length of the shaft.

6. The fid of claim 1, wherein the rope holder comprises a braided wire basket.

7. The fid of claim 6, wherein the wire basket comprises a helically wound biaxial braid.

8. A method of making a fid comprising forming an elongate needle with a tip at a first end and a connection structure at an opposing second end;

forming a coupler having an opposing connection structure at a first longitudinal end configured to releasably and removably couple with the connection structure of the elongate needle and further having a connector at a second longitudinal end;

forming a rope holder configured to retain an end of a rope within a first end thereof and a having a second end configured for coupling with the connector of the coupler;

permanently affixing the second end of the rope holder to the coupler with the connector;

forming the connector on the coupler as a ferrule in the form of a sleeve;

inserting the second end of the rope holder within the sleeve; and crimping the sleeve to compress the sleeve radially inward against the second end of the rope holder to permanently retain the second end of the rope holder within the ferrule.

9. The method of claim 8 further comprising forming the connection structure on the elongate needle as a threaded shaft; and forming the opposing connection structure on the coupler as a threaded surface on an interior wall of a bore defined within the coupler.

10. The method of claim 8 further comprising forming the connection structure on the elongate needle as a threaded surface on an interior wall of a bore defined within the second end of the elongate needle; and forming the opposing connection structure on the coupler as a threaded shaft.

11. The method of claim 8 further comprising forming the rope holder as a braided wire basket.

12. The method of claim 11 further comprising forming the wire basket as a helically wound biaxial braid.

13. A method for splicing a high modulus polyethylene rope comprising selecting a fid constituting separate components including an elongate needle, a rope holder, and a coupler for attaching the elongate needle and the rope holder together; wherein the rope holder is permanently attached to the coupler;

removably coupling the elongate needle to the coupler to form a fid configured to attach to a bury end of a length of rope;

removably coupling a bury end of a length of rope to the rope holder;

inserting the fid between braided strands of the rope at an insertion location;

advancing the fid within a center core of the rope thereby pulling the bury end of the rope within the center core;

exiting the fid from between the braided strands of the rope at a distance spaced apart from the insertion location; and uncoupling the bury end of the rope from the rope holder.

14. The method of claim 13 further comprising uncoupling the elongate needle from the coupler.

15. A fid comprising an elongate needle having a tip at a first end, a shaft, a measuring tool in the form of bury length markings provided along a length of the shaft, and a connection structure at an opposing second end;

a coupler having an opposing connection structure at a first longitudinal end configured to releasably and removably couple with the connection structure of the elongate needle and further having a connector at a second longitudinal end; and a rope holder configured to retain an end of a rope within a first end thereof and a having a second end configured for coupling with the connector of the coupler.

16. A fid comprising an elongate needle having a tip at a first end, a shaft, an informational tool in the form of bury depth markings provided along a length of the shaft, and a connection structure at an opposing second end;

a coupler having an opposing connection structure at a first longitudinal end configured to releasably and removably couple with the connection structure of the elongate needle and further having a connector at a second longitudinal end; and a rope holder configured to retain an end of a rope within a first end thereof and a having a second end configured for coupling with the connector of the coupler.

* * * * *